US007240613B2

(12) United States Patent
Herrmann

(10) Patent No.: US 7,240,613 B2
(45) Date of Patent: Jul. 10, 2007

(54) METHOD FOR DRIVING A SATELLITE OFFSET PRESS AND SATELLITE OFFSET PRESS

(75) Inventor: Bernd Herrmann, Malsch (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 11/305,140

(22) Filed: Dec. 16, 2005

(65) Prior Publication Data

US 2006/0130681 A1 Jun. 22, 2006

(30) Foreign Application Priority Data

Dec. 16, 2004 (DE) ..... 10 2004 060 524

(51) Int. Cl.
*B41F 33/08* (2006.01)
*B41F 5/16* (2006.01)
*B41F 5/18* (2006.01)

(52) U.S. Cl. ..... 101/177; 101/217; 101/232

(58) Field of Classification Search ..... 101/377, 101/177, 217, 183, 184, 175
See application file for complete search history.

(56) References Cited

U.S. PATENT DOCUMENTS 6,070,529 A * 6/2000 Miller ..... 101/248
2003/0061952 A1* 4/2003 Schwitzky ..... 101/181
2003/0164101 A1 9/2003 Dagher

FOREIGN PATENT DOCUMENTS

| | | |
|---|---|---|
| DE | 197 56 796 A1 | 7/1999 |
| DE | 695 17 165 T2 | 11/2000 |
| DE | 100 59 809 A1 | 6/2001 |
| DE | 102 59 496 A1 | 3/2004 |
| JP | 10-286938 | 10/1998 |

* cited by examiner

*Primary Examiner*—Daniel J. Colilla
*Assistant Examiner*—Marissa Ferguson-Samreth
(74) *Attorney, Agent, or Firm*—Laurence A. Greenberg; Werner H. Stemer; Ralph E. Locher

(57) ABSTRACT

A method for driving a satellite offset press, and a satellite offset press which, with little expenditure, permits multicolor printing in one pass. A satellite offset press, in which form cylinders and associated transfer cylinders are driven synchronously, while in each case segments located in the circumferential direction of the form cylinders and of the transfer cylinders and also of the transfer cylinders and of an impression cylinder interacting with the latter roll on one another in accurate register with a sheet held thereon, following each full revolution. The speed of the impression cylinder is reduced and increased again, so that the transfer cylinders lead by at least one segment length in the circumferential direction.

6 Claims, 7 Drawing Sheets

FIG. 2.1
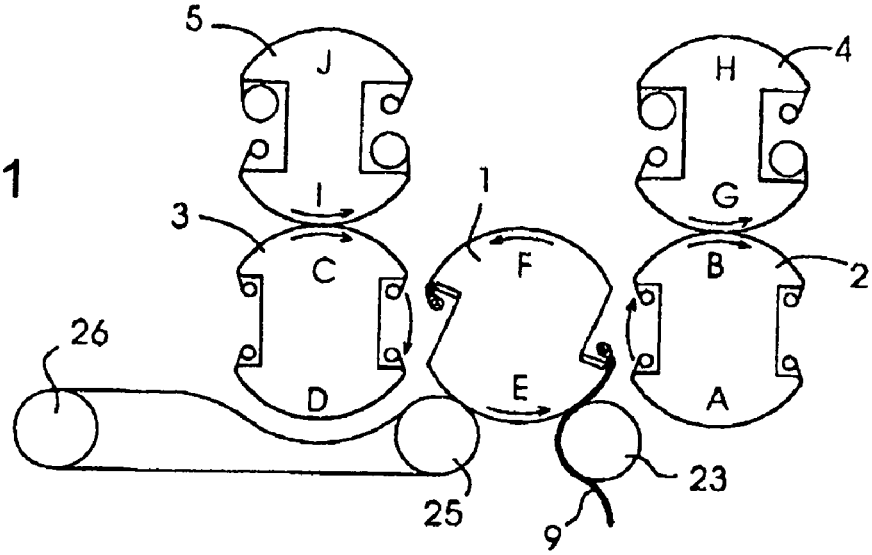
FIG. 2.2
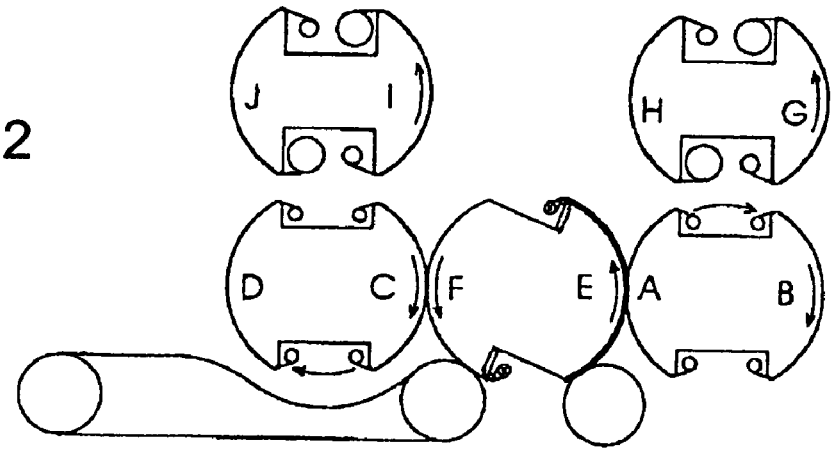
FIG. 2.3
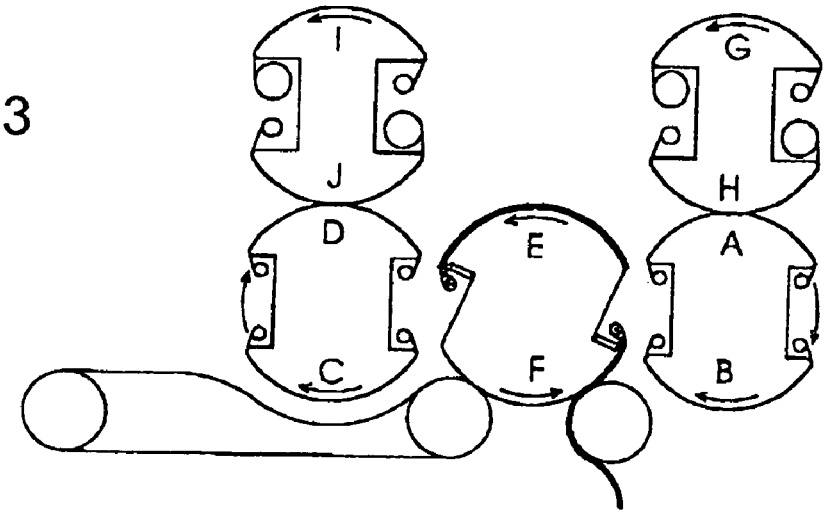

FIG. 2.4
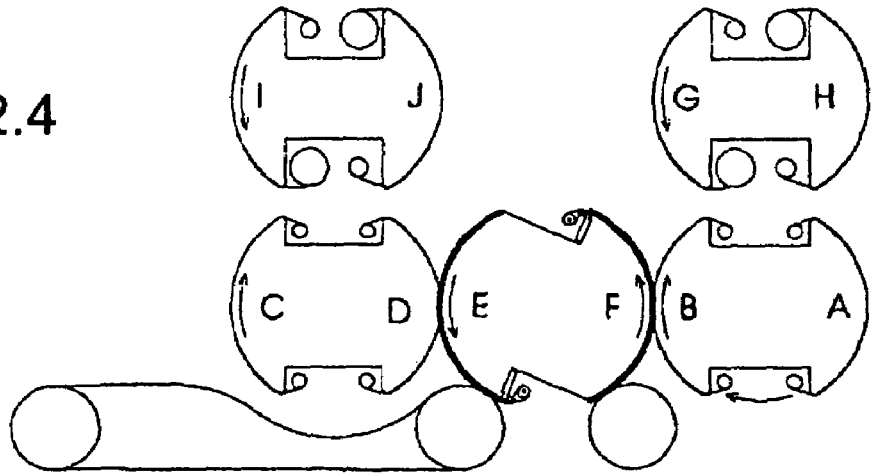
FIG. 2.5
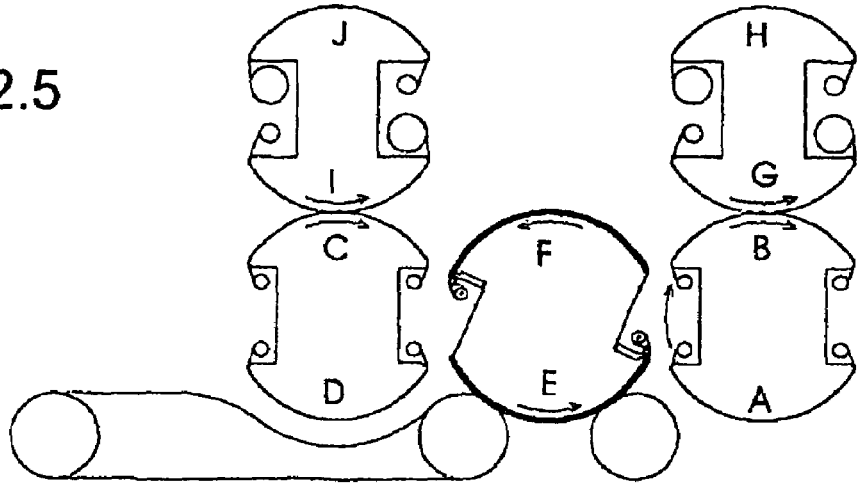
FIG. 2.6
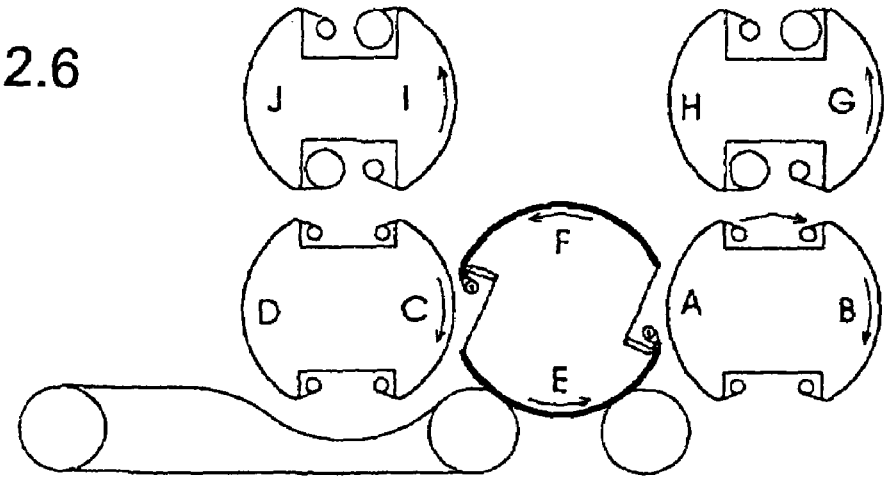

FIG. 2.7
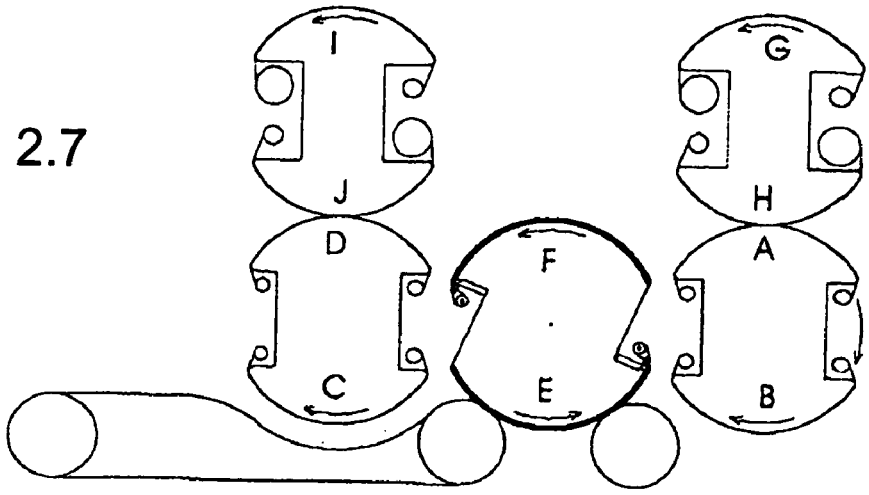
FIG. 2.8
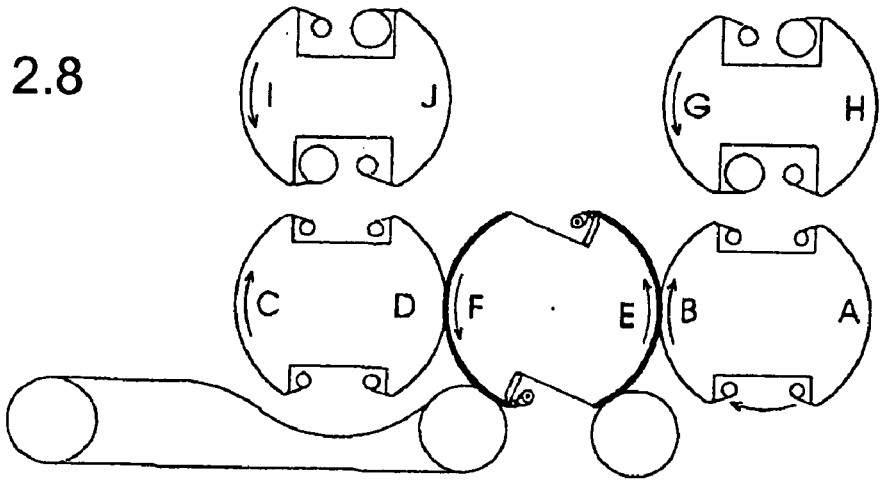
FIG. 2.9
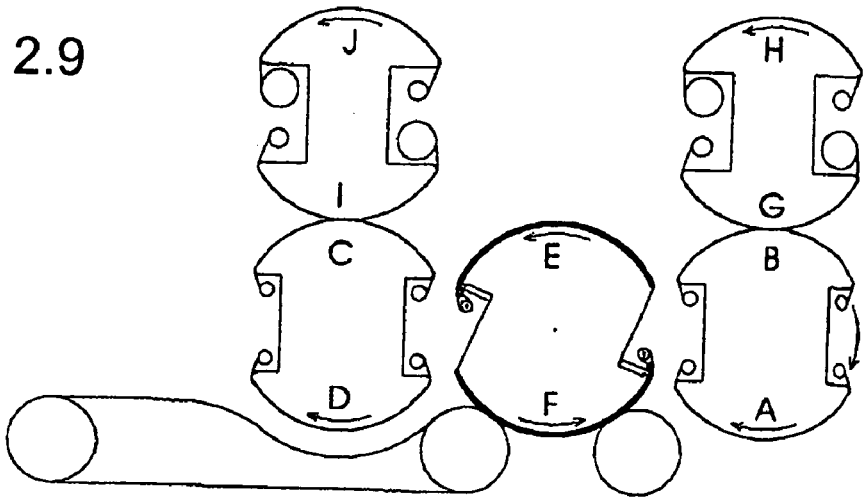

FIG. 2.10
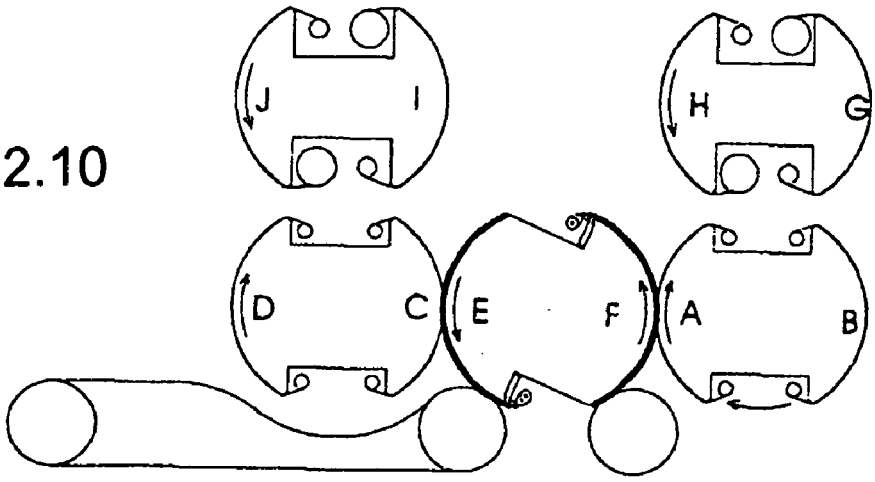
FIG. 2.11
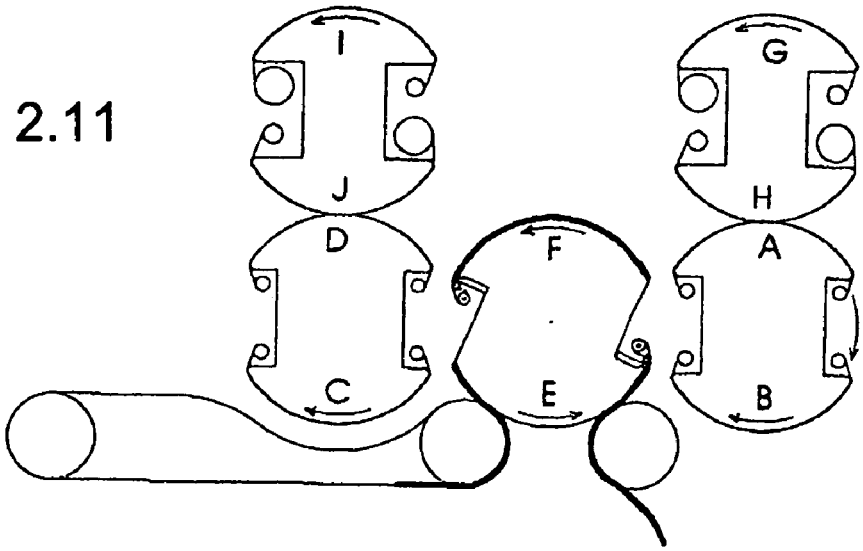
FIG. 2.12
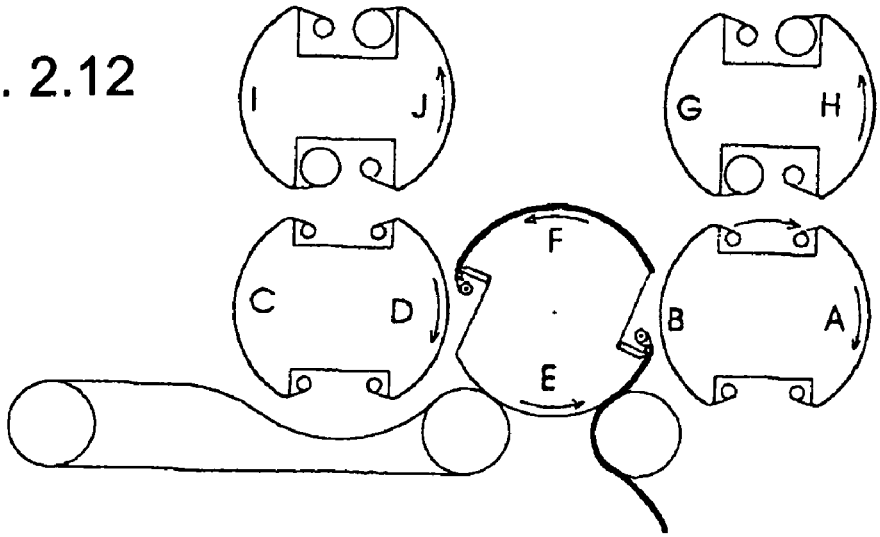

FIG. 2.13
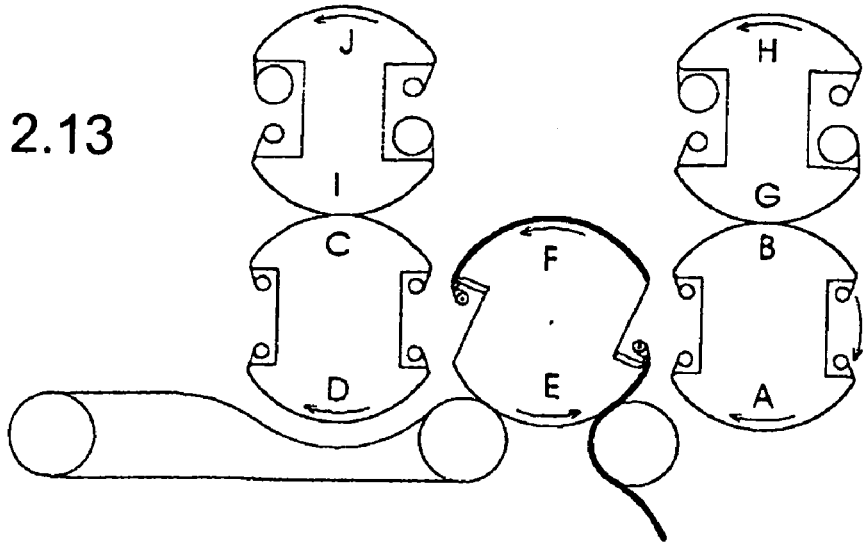
FIG. 2.14
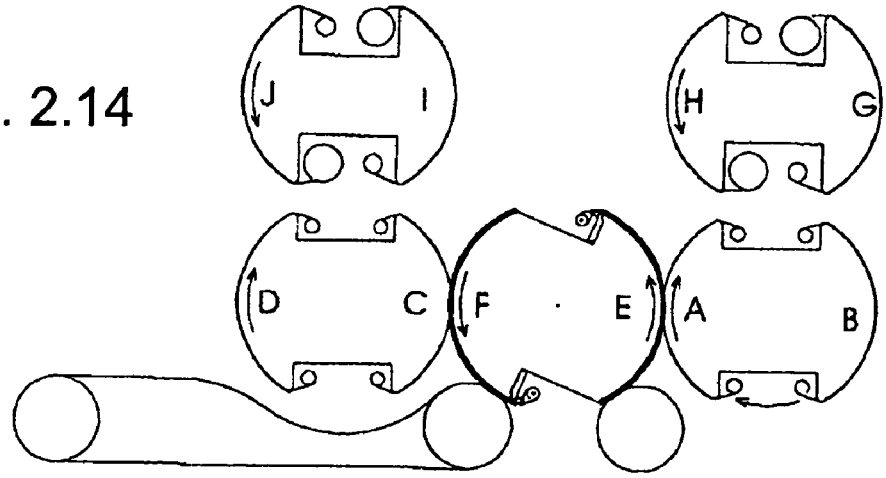
FIG. 2.15
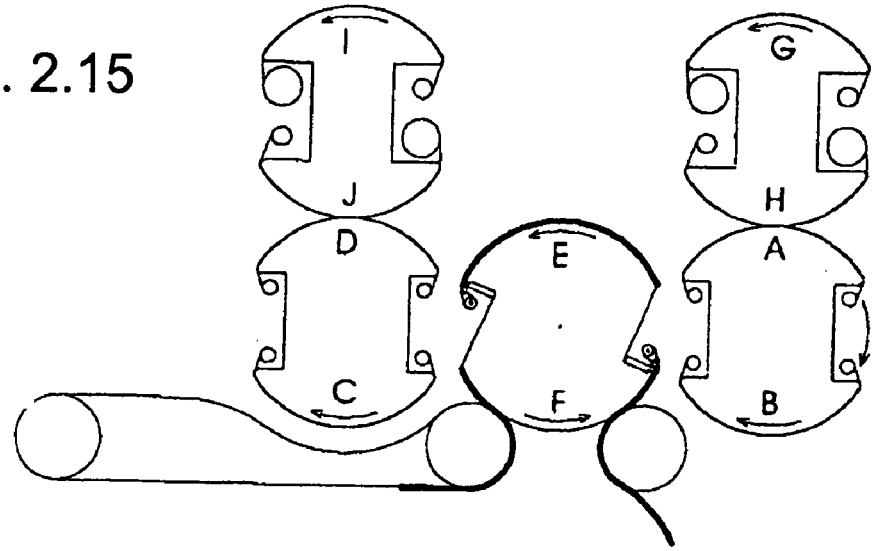

METHOD FOR DRIVING A SATELLITE OFFSET PRESS AND SATELLITE OFFSET PRESS

BACKGROUND OF THE INVENTION

Field of the Invention

The invention relates to a method for driving a satellite offset press, in which form cylinders and associated transfer cylinders are driven synchronously, while in each case segments located in the circumferential direction of the form cylinders and of the transfer cylinders and also of the transfer cylinders and of an impression cylinder interacting with the latter roll on one another in accurate register with a sheet held thereon. The invention further relates to a satellite offset press having an impression cylinder which interacts with at least two satellite printing units in order to print on sheets. Each of the printing units contains at least one transfer cylinder and a form cylinder having an inking unit. The impression cylinder, the transfer cylinder and the form cylinder have equally long segments located in the circumferential direction. A device for leading the sheets to and from the impression cylinder, and at least one drive device for the cylinders, are provided.

Published, non-prosecuted German patent application DE 102 59 496 A1 discloses an offset press for multicolor printing on a printing material, in which an impression cylinder, a transfer cylinder and a printing form cylinder each have at least three equally long segments located in the circumferential direction. The number of segments on the transfer cylinder corresponds to an-integer multiple of the number of segments on the impression cylinder plus one segment. All the cylinders can conventionally be driven by a gear wheel mechanism. Likewise, individual cylinders or groups of cylinders can be provided with individual drives. In any case, the cylinders are driven such that the segments roll on one another in accurate register. In the case of four-color printing, the result is press configurations with voluminous cylinders, which are expensive in terms of material and costs.

SUMMARY OF THE INVENTION

It is accordingly an object of the invention to provide a method for driving a satellite offset press, and a satellite offset press which overcome the above-mentioned disadvantages of the prior art devices and methods of this general type, which, with little expenditure, permit multicolor printing in one pass.

With the foregoing and other objects in view there is provided, in accordance with the invention, According to the invention, a central impression cylinder is provided with an individual drive and is braked and accelerated during a revolution such that the transfer cylinders driven in synchronism with the printing form cylinder lead by one segment length in the circumferential direction.

Given a specific geometric configuration of double-size transfer cylinders and likewise double-size printing form cylinders, the width in the circumferential direction of a channel in the impression cylinder is in each case so large that, as the channel on the transfer cylinder passes, the rotational speed of the impression cylinder is reduced by a servo drive such that, in the intervening time, the transfer cylinder and printing form cylinder rotate one printing area further. At the correct time in relation to the printing start of the following printing areas of the transfer cylinders, the impression cylinder is accelerated to the circumferential speed of the transfer cylinders.

Other features which are considered as characteristic for the invention are set forth in the appended claims.

Although the invention is illustrated and described herein as embodied in a method for driving a satellite offset press, and a satellite offset press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

FIGS. 2.1–2.15 are schematic phase drawings of the satellite offset press according to FIG. 1 in 90 degree steps.

DESCRIPTION OF THE PREFERRED EMBODIMENTS

Figure 1:
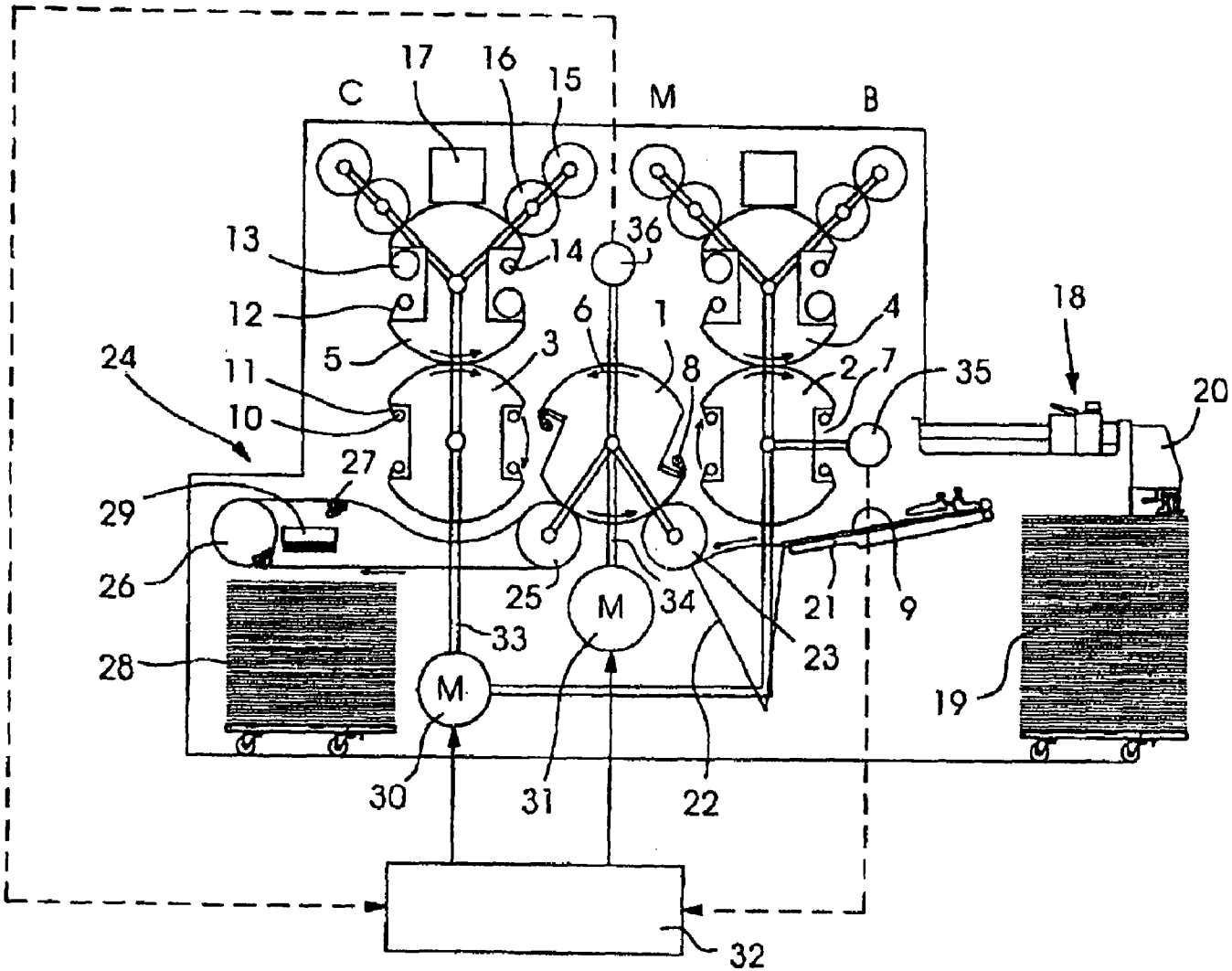
FIG. 1 is a diagrammatic, illustration of a satellite offset press according to the invention.

Referring now to the figures of the drawing in detail and first, particularly, to FIG. 1 thereof, there is shown a schematic drawing of a satellite offset press having an impression cylinder 1, two transfer cylinders 2, 3 and two printing form cylinders 4, 5. The cylinders 1–5 can be rotated in the direction of arrows 6, an axes of rotation of the impression cylinder 1 and of the transfer cylinders 2, 3 lying in parallel in a horizontal plane h and the axes of rotation of the printing form cylinders 4, 5 and of the transfer cylinders 2, 3 each lying in a vertical plane v. Each cylinder 1–5 has two segments A–J with equally long printing areas in the circumferential direction. Between the segments A–J, the cylinders 1–5 have channels 7. In the channels 7 of the impression cylinder 1 there are gripper systems 8 for holding sheets 9. In the channels 7 of the transfer cylinders 2, 3 there are holding and clamping devices 10 for an elastic cover 11 on each segment A–D. Drawn onto the segments G–J of the printing form cylinders 4, 5 is a printing film 12, which is in each case stored on an unwind roller 13 and tensioned via a rewind spool 14. During printing, the covers 11 are in rolling contact with a sheet 9 held on the segments E, F. Likewise, there is contact between a printing film 12 and a respective cover 11. The printing form cylinders 4, 5 are assigned rolls 15 of inking units, in each case it being possible for an ink applicator roll 16 to be thrown onto and off the printing film 12. Furthermore, each printing form cylinder 4, 5 is assigned an imaging configuration 17, which contains laser diode arrays, with which image points accepting printing ink can be produced on the printing films 12.

The satellite offset press further contains a feeder 18 for separating sheets 9 from a stack 19 and for feeding the sheets 9 into the gripper system 8. In detail, the feeder 18 includes a suction head 20, a feed table 21 with tape transport system, a swinging gripper 22 and a feed drum 23.

Furthermore, the satellite offset press includes a deliverer 24 having a chain gripper system 27 led over deflection rollers 25, 26 for conveying the sheets 9 from the gripper system 8 onto a stack 28. A dryer 29 is disposed on the conveying path of the sheets 9.

In order to drive the satellite offset press, two motors 30, 31 are provided, which are connected to a control device 32. The motor 30 is connected via a gear mechanism 33 to a gear train which is used to drive the transfer cylinders 2, 3, the printing form cylinders 4, 5 and the inking unit rolls 15, 16. The motor 31 is connected via a gear mechanism 34 to a gear train for driving the impression cylinder 1, the feed drum 23 and the deflection roller 25. The rotational position of the transfer cylinders 2, 3 and of the printing form cylinders 4, 5 is registered by a rotary encoder 35. The rotational position of the impression cylinder 1 is obtained by a rotary encoder 36. The rotary encoders 35, 36 are connected to a control device 32.

By using FIGS. 2.1–2.15, the functioning of the satellite offset press is to be explained in more detail. Using the imaging configurations 17, partial images in the primary colors cyan, yellow, magenta and black are produced on the printing films 12. For this purpose, the impression cylinder is brought by the motor 31 into the rotational position shown in FIG. 1 and fixed, in which position the channels 7 are opposite the transfer cylinders 2, 3. Using the motor 30, the printing form cylinders 4, 5 are driven for the purpose of imaging. The imaging rotational speed depends on the characteristics of the printing film 12 and on the power and number of laser diodes of the laser diode array in the imaging arrangements 17. During imaging, the transfer cylinders 2, 3 and the ink applicator rolls 16 are thrown off the printing form cylinders 4, 5.

During printing, the transfer cylinders 2, 3 are thrown onto the printing form cylinders 4, 5. The printing form cylinders 12 are inked by the ink applicator rolls 16, an ink applicator roll 16 in each case inking a printing film 12 in that, during one revolution of a printing form cylinder 4, 5, it is thrown cyclically onto the relevant printing film 12 and lifted off again. During printing, the transfer cylinders 2, 3 and the printing form cylinders 4, 5 rotate synchronously and continuously with an approximately equal circumferential speed, ink being transferred from the printing films 12 to the covers 11.

FIG. 2.1 shows the satellite offset press at a machine angle of 0 degrees. A sheet 9 has been transferred into the gripper system of the segment E of the impression cylinder 1. The impression cylinder 1 has the same circumferential speed as the adjacent transfer cylinders 2, 3. When the impression cylinder 1, the transfer cylinders 2, 3 and the printing form cylinders 4, 5 rotate synchronously onward, then the sheet is printed with the color black. The segments A, E of the transfer cylinder 2 and of the impression cylinder 1 roll on one another, which is shown at a machine angle of 90 degrees in FIG. 2.2. In FIG. 2.3, at a machine angle of 180 degrees, it is shown that a second sheet 9 has been transferred into the gripper system 8 of the segment F of the impression cylinder 1. During synchronous onward rotation of the impression cylinder 1 and of the adjacent transfer cylinders 2, 3, as shown in FIG. 2.4 at a machine angle of 270 degrees, the second partial image is printed on the sheet 9 in the color cyan on the second segment E, and the first partial image in the color magenta is printed on the segment F. As soon as these partial images of the colors cyan, magenta have been printed, the impression cylinder is braked, while the adjacent transfer cylinders continue to revolve uniformly. The transfer cylinders 2, 3 then lead by one printing area, which is shown in FIGS. 2.5–2.7 at a machine angle of 360 degrees to 540 degrees. At the correct time in relation to the printing start of segments A, C of the transfer cylinders 2, 3, the impression cylinder 1 has been accelerated again to the uniform speed of revolution of the transfer cylinders 2, 3. As shown in FIG. 2.8 at a machine angle of 630 degrees, the sheet 9 then receives the second partial image in the color yellow in segment F, and the sheet 9 receives the third partial image in the color magenta in segment E. During synchronous onward rotation of the impression cylinder 1, transfer cylinders 2, 3 and printing form cylinders 4, 5, as shown in FIGS. 2.9 and 2.10 at a machine angle of 720 and 810 degrees, the fourth partial image in the color yellow is printed on the sheet 9 in segment E, and the third partial image in the color black is printed on the sheet 9 in segment F. When the sheet 9 has been printed completely in segment E, the impression cylinder 1 is braked again after the printing end, while the transfer cylinders 2, 3 and printing form cylinders 4, 5 rotate synchronously onward. As illustrated in FIG. 2.11 at a machine angle of 900 degrees, the sheet 9 is transferred to the chain gripper system 27 of the deliverer 24, while a still unprinted sheet 9 is fed to the gripper system 8 on segment E. Therefore, in order to finish a sheet 9, 2.5 revolutions of the impression cylinder 1 are needed. FIGS. 2.12 and 2.13 show the onward rotation of the transfer cylinders 2, 3 by one printing area at a machine angle of 990 degrees and 1080 degrees. At the machine angle of 1080 degrees, the impression cylinder 1 has been accelerated to the speed of revolution of the adjacent transfer cylinders 2, 3 again, so that the third revolution of the impression cylinder 1 begins. The second sheet 9 then receives a print with the fourth partial image in the color yellow in segment F. The third sheet 9 receives a first partial image in the color black in segment E. This phase is illustrated at a machine angle of 1170 degrees in FIG. 2.14. During the synchronous onward rotation of the impression cylinder 1 and of the transfer cylinders 2, 3 and printing form cylinders 4, 5, the second sheet 9 is printed out completely in segment E. As illustrated in FIG. 2.15 at a machine angle of 1260 degrees, the second sheet is transferred to the chain gripper system 27 of the deliverer 24, while a next unprinted sheet 9 is fed to the gripper system 8 on segment E.

The inking units of such a satellite offset press can be constructed with conventional zonal ink metering elements or else as anilox inking units.

Figure 3:
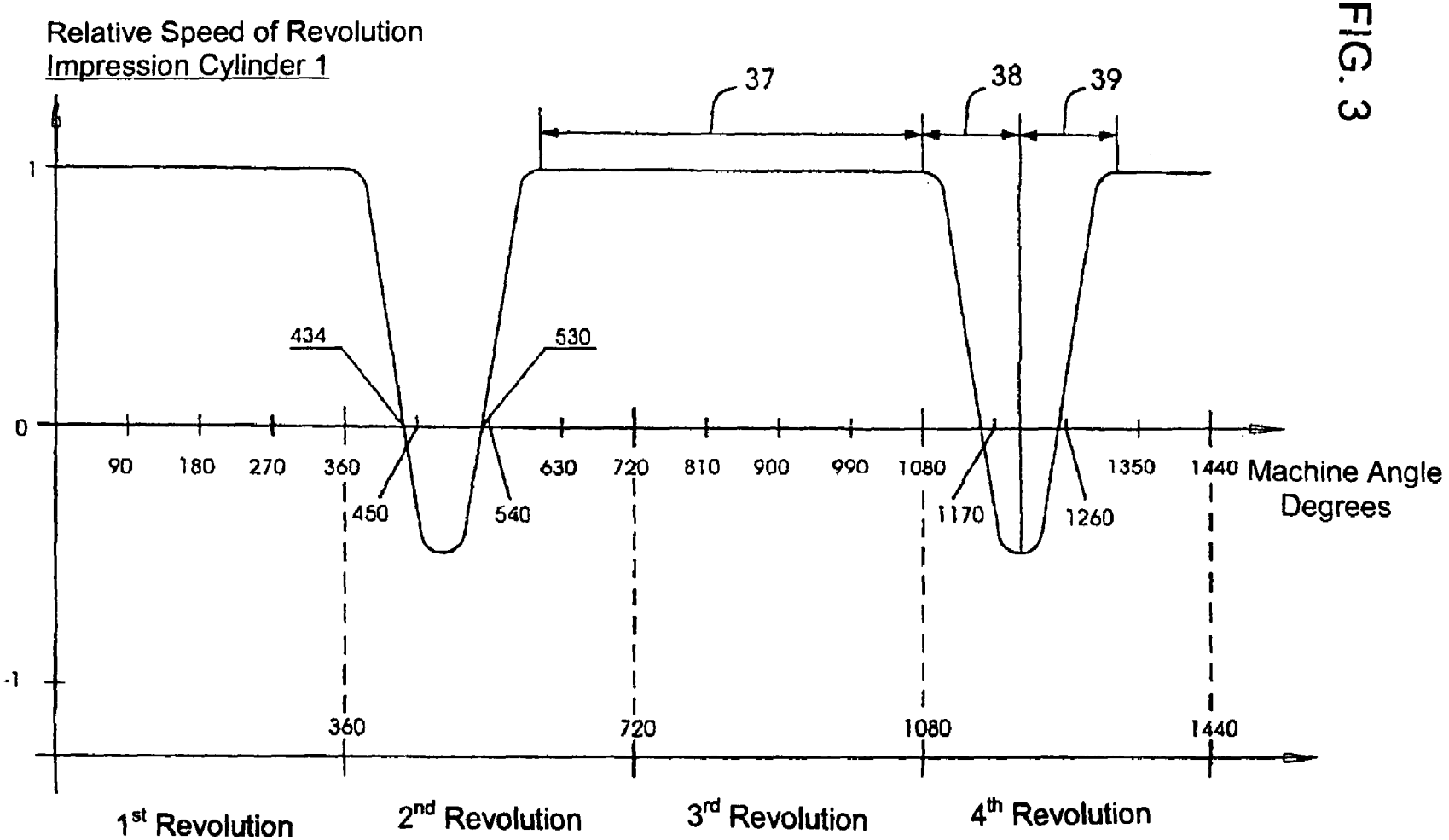
FIG. 3 is a graph showing a curve of the speed of an impression cylinder as a function of a machine angle.

FIG. 3 shows a curve of the circumferential speed of the impression cylinder 1. The control device 32 is used to set the motor 31 in such a way that, in addition to phases 37 with synchronous running of impression cylinder and adjacent transfer cylinders 2, 3, there are also braking phases 38 and acceleration phases 39 of the impression cylinder 1. In order to produce the actuating signals for the motor 31; the signals from the rotary encoders 35, 36 are processed in the control device 32. The control device 32 and the motor 31 are configured in such a way that the braking phase 38 and the acceleration phase 39 expire in a short time.

I claim:

1. A method for driving a satellite offset press, which comprises the steps of:

driving form cylinders and associated transfer cylinders synchronously, while in each case segments located in a circumferential direction of the form cylinders and of the transfer cylinders and also of the transfer cylinders and of an impression cylinder interacting with the latter roll on one another in accurate register with a sheet held thereon; and following each full revolution, reducing and increasing again a speed of the impression cylinder, so that the transfer cylinders lead by at least one segment length in the circumferential direction.

2. The method according to claim 1, which further comprises reducing and increasing again the speed of the impression cylinder when a channel existing between the segments of the transfer cylinders is opposite the impression cylinder.

3. A satellite offset press, comprising:

at least two satellite printing units, said satellite printing units having transfer cylinders and form cylinders with inking units;

an impression cylinder interacting with said at least two satellite printing units for printing sheets, said impression cylinder, said transfer cylinders and said form cylinders each having two equally long segments disposed in a circumferential direction;

a device for leading the sheets to and from said impression cylinder; and at least one drive for driving said transfer cylinders and said form cylinders synchronously, said at least one drive device having a separate further drive for driving said impression cylinder, said driving of said impression cylinder being controlled independently of said driving of said transfer cylinders and said form cylinders for varying a speed of said impression cylinder during a revolution of said transfer cylinders.

4. The satellite offset press according to claim 3, wherein:

said impression cylinder has an axis; and said transfer cylinders have axes lying in parallel with said axis of said impression cylinder in a horizontal plane.

5. The satellite offset press according to claim 4, wherein said form cylinders have axes lying in parallel in a plane with said axes of said transfer cylinders, said plane is substantially perpendicular to said horizontal plane.

6. The satellite offset press according to claim 3, wherein said at least one drive device has a motor for driving said form cylinders and said transfer cylinders jointly.

* * * * *